US007637406B2

(12) United States Patent
Deng et al.

(10) Patent No.: US 7,637,406 B2
(45) Date of Patent: Dec. 29, 2009

(54) NAILING MACHINE DRIVEN BY PRESSURIZED GAS IN LIQUID STATE

(75) Inventors: Dongwei Deng, Guangdong (CN); Qingchang Wang, Guangdong (CN); Zhijun Li, Guangdong (CN)

(73) Assignee: Shenzhen Yuanheng Electronmagnetic Tech. Co., Ltd., Shenzhen (CN)

( * ) Notice: Subject to any disclaimer, the term of this patent is extended or adjusted under 35 U.S.C. 154(b) by 84 days.

(21) Appl. No.: 11/913,846

(22) PCT Filed: May 8, 2005

(86) PCT No.: PCT/CN2005/000631

§ 371 (c)(1), (2), (4) Date: Nov. 7, 2007

(87) PCT Pub. No.: WO2006/119665

PCT Pub. Date: Nov. 16, 2006

(65) Prior Publication Data

US 2008/0185416 A1 Aug. 7, 2008

(51) Int. Cl.
*B25C 1/04* (2006.01)

(52) U.S. Cl. ..... 227/130; 227/112; 227/120

(58) Field of Classification Search ..... 227/130, 227/112, 120

See application file for complete search history.

(56) References Cited

U.S. PATENT DOCUMENTS

| | | | | |
|---|---|---|---|---|
| 2,673,069 | A * | 3/1954 | Carpenter | 175/93 |
| 4,936,282 | A * | 6/1990 | Dobbins et al. | 124/74 |
| 5,494,024 | A * | 2/1996 | Scott | 124/73 |
| 5,542,406 | A * | 8/1996 | Oneto | 124/73 |
| 5,799,739 | A * | 9/1998 | Takaada et al. | 173/217 |
| 6,095,392 | A * | 8/2000 | Batts et al. | 227/8 |
| 6,543,475 | B2 * | 4/2003 | Colby | 137/505.25 |
| 6,739,323 | B2 * | 5/2004 | Tippmann, Jr. | 124/51.1 |
| 6,796,387 | B1 * | 9/2004 | Lund et al. | 173/104 |
| 7,063,247 | B1 * | 6/2006 | Lund et al. | 227/10 |
| 7,168,603 | B1 * | 1/2007 | Lund et al. | 227/10 |
| 2003/0173393 | A1 * | 9/2003 | Kral | 227/130 |
| 2008/0251559 | A1 * | 10/2008 | Uejima et al. | 227/3 |
| 2008/0314953 | A1 * | 12/2008 | Moeller et al. | 227/109 |
| 2009/0020582 | A1 * | 1/2009 | Kubo | 227/120 |
| 2009/0071998 | A1 * | 3/2009 | Nakano et al. | 227/8 |

* cited by examiner

*Primary Examiner*—Brian D Nash

(57) ABSTRACT

The present invention relates to a nail shooter. The present invention provides the nail shooter driven by a high-pressurized gas in liquid state, in order to resolve technical problems with the prior nail shooters, such as difficulty in application, a loud noise, a safety hazard. The shooter body is provided with a trigger mechanism, a firing pin used for striking a nail to get it shot, a piston mechanism for pushing the firing pin, and a switch mechanism for releasing the driving gas toward the piston mechanism. The handle of the nail shooter is provided with a coupling tube, which is provided with an intake joint used for introducing the gas from a cylinder containing high-pressurized gas in liquid state and further with a decompressor that decompresses the introduced gas. Under control of the trigger mechanism, the decompressed gas can drive the piston mechanism to act via the switch mechanism, and further push the firing pin to strike a nail at a high speed to get it shot. By adopting the high-pressurized gas in liquid state as a power source, the nail shooter of the present invention needs neither an air compressor nor a power supply, which makes it very convenient, safe and efficient to use, and result in no noise pollution.

13 Claims, 4 Drawing Sheets

NAILING MACHINE DRIVEN BY PRESSURIZED GAS IN LIQUID STATE

FIELD OF THE INVENTION

The present invention relates to a nail shooter of portable manual tools, and more particularly to a nail shooter driven by a high-pressurized gas in liquid state.

BACKGROUND OF THE INVENTION

A nail shooter is used for shooting a nail into a corresponding material to get the material fixed, connected, etc. The prior nail shooters are mainly driven by electricity, pneumaticity, combustion, explosion, etc.

Wherein an electric nail shooter needs to be powered by an external power supply, and therefore it can only be used in a place where there is a power supply and needs to be connected with a power line. It is disadvantageous in that it cannot be used in a place where no electricity is available or there is a power failure.

While a traditional pneumatic nail shooter needs an air compressor to provide a high-pressure gas for it. Since the air compressor can only work with a power supply, it cannot likewise work in a place where no electricity is available or there is a power failure. Besides, the air compressor works with an especially loud noise, which will result in noise pollution.

In Utility Model Patent Number ZL200320118911.1 is publicly disclosed a nail shooter that shoots under action of a piston driven by gas combustion in an internal furnace. It is disadvantageous in that it needs to use combustible gas, which involves a great safety hazard (e.g. fire and explosion) and has a high cost.

In Invention Patent Number ZL 94104976.0 is publicly disclosed a nail shooter that shoots under action of a piston driven by powder explosion. It is disadvantageous in that it needs to use an explosive—powder, which involves an even greater safety hazard and may become an illegal weapon.

CONTENTS OF THE INVENTION

The purpose of the present invention is to provide a nail shooter that is more safe, more efficient, and easy to use, so as to resolve the above-mentioned technical problems with a prior nail shooter, such as difficulty in application, a loud noise, or a safety hazard.

The solution the present invention adopts to resolve the technical problems is as below: A structure is provided, including a shooter body and a handle connected with the same, the shooter body being provided with a trigger mechanism, a firing pin used for striking a nail to get it shot, a piston mechanism used for pushing the firing pin, and a switch mechanism used for releasing the driving gas toward the piston mechanism under control of the piston mechanism.

In the structure:

The handle is provided with a coupling tube;

The coupling tube is provided in lower part of the cavity with an intake joint used for connection with a cylinder containing high-pressurized gas in liquid state to introduce the high-pressure gas;

the coupling tube is provided in central part of the cavity with a decompressor that is connected with the intake joint and decompresses the introduced high-pressure gas so as to keep gas pressure in upper part of the cavity of the coupling tube within a predetermined range; and under control of the trigger mechanism, the gas decompressed in the coupling tube can drive the piston mechanism via the switch mechanism, and further push the firing pin to strike the nail at a high speed to get it shot.

The shooter body of the present invention can include the following components: A main body used for mounting of the switch mechanism, the main body being connected with the handle and provided inside with a switch cavity; a piston tube used for mounting of the piston mechanism, the piston tube being positioned in the front of the main body and provided inside with a piston cavity; and a nail-shooting table positioned in front of the piston tube, and used for fit connection with a nail box containing the nails.

The decompressor of the present invention had better include the following components: A decompression spring positioned in upper part of the cavity of the coupling tube; an up-and-down movable switch positioned in central part of the cavity of the coupling tube; a decompression sealing positioned in upper part of the cavity of the intake joint and provided with a central through hole; a seal ball that is positioned at a lower opening of the central through hole of the decompression sealing and can get the opening sealed; a decompression eject rod extending from lower part of the movable switch into the central through hole of the decompression scaling and pushing open/releasing the seal ball with the movable switch moving up and down; and a ball seat used for holding the seal ball and keeping the seal ball in a position such that it is just opposite to the lower opening of the central through hole of the decompression sealing with an appropriate distance in between. In the structure, upper sectional area of the movable switch is smaller than lower sectional area. A pressure difference produced by the same gas pressure on the upper and lower sections can compress the decompression spring to make the movable switch moving up and down, which further drives the decompression eject rod back into the central through hole of the decompression sealing. The seal ball will be completely released when the pressure difference is equal to elastic force of the decompression spring after being compressed, thus making the seal ball seal the lower opening of the central through hole of the decompression sealing.

The piston mechanism of the present invention had better include the following components: A secondary piston that can move forward and backward in the piston cavity in the middle of the shooter body; a secondary spring that can push the secondary piston forward; a primary cylinder tube positioned in piston cavity of the shooter body such that the piston cavity is divided into inner and outer piston cavities, with rear part of the primary cylinder tube inserted into the secondary piston; primary and secondary shock absorbing sealings positioned at front and rear ends of the primary cylinder tube, respectively; and a primary piston that can move forward and backward inside the primary cylinder tube under push of the gas. In the structure, the primary piston can move forward under push of the high-pressure gas, and the firing pin positioned on the primary piston can move forward and backward with it.

It would be better to provide the following components in the above-mentioned piston mechanism: A return gas hole on the foremost side wall of the primary cylinder tube to communicate the cavity of the primary cylinder tube with the outer piston cavity; a gas outlet positioned on side wall of the primary cylinder tube at an appropriate distance from the front end to communicate cavity of the primary cylinder tube with the outer piston cavity; an one-way valve positioned at the gas outlet to only allow the gas to flow from cavity of the primary cylinder tube to the inner piston cavity; and a vent positioned between the secondary shock absorbing sealing and the secondary switch to communicate the inner piston cavity with the atmosphere.

The trigger mechanism of the present invention had better include the following components: A trigger for an operator to trigger; and a safety trigger rod interlocked with the trigger to control the secondary piston in the piston mechanism. In the structure, the secondary piston is provided at the lower part with a notch, into which projecting end of the safety trigger rod can be inserted to keep the secondary piston in a compressed state. The projecting end of the safety trigger rod can escape from the notch with rotation of the trigger, and then release the secondary piston.

The trigger mechanism had better include the following components in order to ensure that the nail shooter can only shoot a nail while pressing a workpiece tightly: A safety press piece that is positioned at a nail shooting port of the shooter body, and can retract back to being parallel and level with the nail shooting port when being pressed; a safety transfer piece connected with the safety press piece; a junction plate that is connected with the safety transfer piece and can move forward and backward; a safety spring that can push the junction plate forward to get reset; and a safety interlocking plate that can move back with the junction plate to get in contact with bayonet of the trigger. In the structure, the safety trigger rod is connected with the safety interlocking plate via a guide pillar and can rotate under pull of the safety interlocking plate, and thereby projecting end of the safety trigger rod can escape from lower notch of the secondary piston and release the secondary piston.

The switch mechanism of the present invention can be positioned in the switch cavity at the back of the shooter body, the switch mechanism including the switch mechanism that is positioned in the switch cavity at the back of the shooter body.

The switch mechanism includes the following components: A main switch that is fixed together with the secondary piston via a hammer striking plate and can move forward and backward in the switch cavity; a secondary switch that is sleeved outside the primary switch and can escape from the switch sealing at back of the primary switch with the primary switch moving forward; and a switch spring that can push the secondary switch back. In the structure: The primary switch is provided in the rear middle with a primary switch blowhole, which is provided on both sides with a sealing; the primary switch can move forward with the secondary piston, and drive the secondary switch to escape from the switch sealing positioned at back of the secondary switch, thus making the gas in the coupling tube flow into the primary switch via an opening at the switch sealing and the primary switch blowhole and further into the inner piston cavity to push the primary piston.

It would be better to provide the following components in the present invention: A female thread at lower opening of the coupling tube for screwing the cylinder; a hollow protruding rod that is positioned below the intake joint and can be connected with the cylinder to introduce the high-pressure gas;

Also a cylinder used for containing the high-pressurized gas in liquid state; a cylinder joint at opening of the cylinder; a cylinder rod that is positioned in the cylinder joint and can move up and down; a cylinder sealing that is positioned at lower part of the cylinder rod and can seal/open a gas port inside the cylinder joint with the cylinder rod moving up/down; and a male thread on external diameter of the cylinder joint, the cylinder being screwed to lower part of the coupling tube through matching of the male and female threads.

In the structure, the hollow protruding rod can push against an intake rod provided with the cylinder to make the intake rod move down, thus opening the cylinder sealing to introduce the high-pressure gas in the cylinder into the coupling tube.

The present invention can further include a nail box used for containing a multiple of pin nails, straight nails, staples, or cement nails.

It can be known from the above-mentioned technical solution that, by adopting the high-pressurized gas in liquid state as the power source, the nail shooter of the present invention needs neither a bulky air compressor nor a power supply, which makes it appropriate for various occasions and very convenient, safe and efficient to use. Inert gases that neither burn nor support combustion can be used as the high-pressurized gas in liquid state. With no need for an air compressor, the nail shooter can be used with a very low noise and will not result in noise pollution.

BRIEF DESCRIPTION OF THE DRAWINGS

The present invention will be further described below with reference to drawings and embodiments.

In the drawings.

DETAILED DESCRIPTION OF THE EMBODIMENTS

Figure 1:
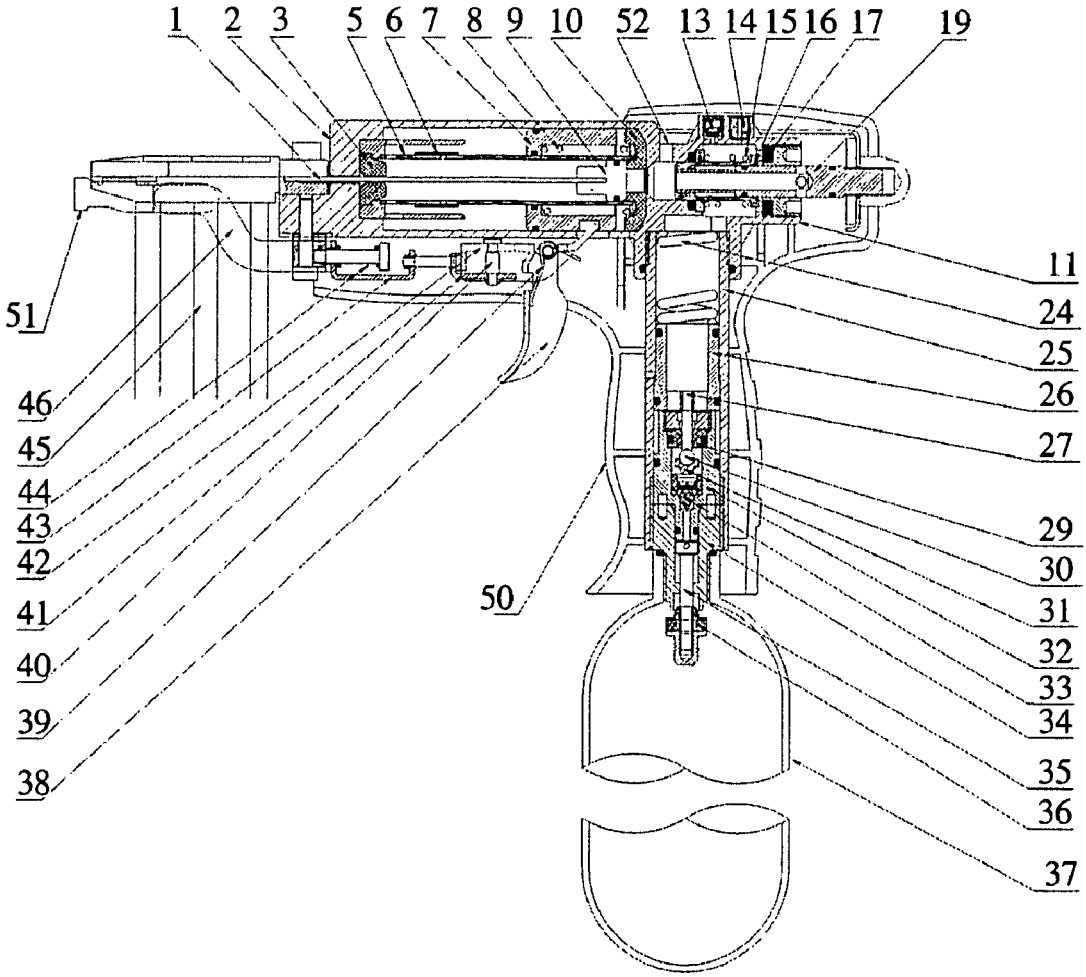
FIG. 1 is a structural schematic view of the nail shooter of an embodiment of the present invention where the nail shooter is not in use.

A preferred embodiment of the present invention is shown in FIGS. 1 to 6. A detailed description will be given below with reference to these drawings. It can be seen from the drawings that the nail shooter primarily includes the shooter body and the handle 50. The shooter body is further composed of the main body 11, the piston tube, and the nail-shooting table connected successively. The piston tube is provided inside with the piston cavity used for mounting of the piston mechanism. The main body 11 is provided inside with the switch cavity used for mounting of the switch mechanism. Below the nail-shooting table is positioned the nail box used for containing nails (the drawing is not complete where six vertical lines are shown).

Wherein the piston mechanism primarily includes the following components: Outer tube 2, secondary piston 7, secondary spring 8, primary piston 9, primary shock absorbing sealing 3, secondary shock absorbing sealing 10, primary cylinder tube 5, and one-way valve 6 positioned at the primary cylinder tube; in the structure, inside the primary cylinder tube 5 is the inner piston cavity, while outside the outer piston cavity.

The switch mechanism primarily includes the following components: Hammer striking plate 20, primary switch 19, secondary switch 16, switch spring 15, and switch sealing 17.

The trigger mechanism primarily includes the following components: Trigger 38, trigger spring 39, guide pillar 40, safety interlocking plate 41, safety trigger rod 42, junction plate 43, safety spring 44, safety transfer piece 46, and safety press piece 50.

The decompressor primarily includes the following components: Coupling tube 25, decompression spring 24, movable switch 26, decompression eject rod 27, decompression sealing 29, seal ball 30, ball seat 31, and intake joint 32.

The cylinder primarily includes the following components: Cylinder 37, cylinder joint 34, and cylinder sealing 36.

1. Work Process

A. Mounting the Cylinder

As shown in FIG. 1: First screw the cylinder 37 containing the high-pressurized gas in liquid state (the high-pressurized gas in liquid state can be carbon dioxide and nitrogen, or such inert gases as argon) to the lower thread of the coupling tube 25 inside the handle 50; opening of the cylinder 37 moves up to lower part of the intake joint 32, and the cylinder 37 is further screwed; here the hollow protruding rod below the intake joint 32 will press against and move the cylinder rod 35 inside the cylinder joint 34, making the cylinder rod 35 move down; therefore, the cylinder sealing 36 on the cylinder rod 35 will be driven to move down; here the cylinder sealing 36 will escape from lower opening of the cylinder joint 34, making the high-pressure gas inside the cylinder 37 flow up from here and arrive the decompressor inside the coupling tube 25 via the intake joint 32; and the high-pressure gas is decompressed in the decompressor, and the decompressed high-pressure gas can be sent into the switch cavity at the back of the main body 11, to be prepared for nail shooting.

B. Shooting the Nail

While shooting a nail, a shooting action can be completed by pressing the safety press piece 51 at the nail shooting port of the nail shooter tightly against a workpiece, and triggering the trigger 38. As shown in FIG. 1: When the nail shooter is not pressed tightly against the workpiece, under action of the safety spring 44, the junction plate 43 is on the leftmost side, while the safety interlocking plate 41 connected with it also on the leftmost side at a distance from the trigger 38, thus being able to get rid of control of the trigger 38; here the trigger 38 will not affect the safety interlocking plate 41, and then will not drive the safety trigger rod 42 to move, making the nail shooter in a state of being unable to shoot.

Figure 2:
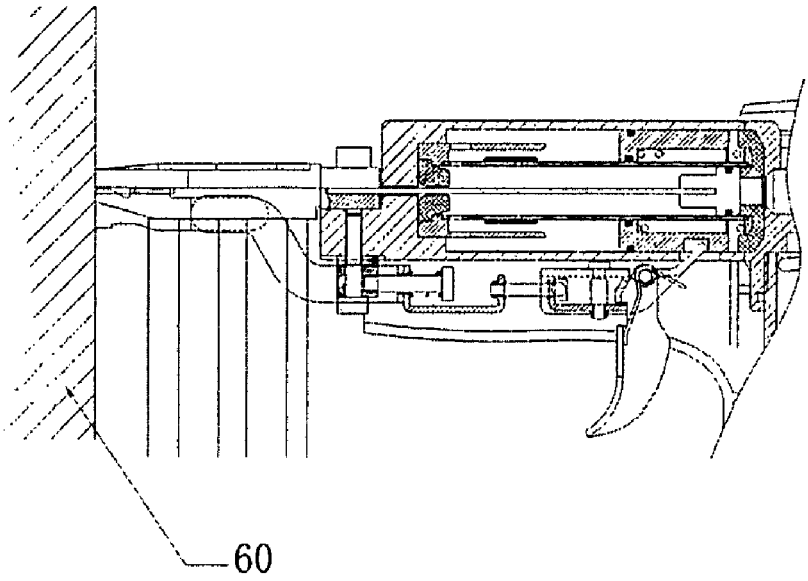
FIG. 2 is a structural schematic view of the nail shooter in FIG. 1 that is ready to be triggered with its port pressing against a workpiece.
Figure 3:
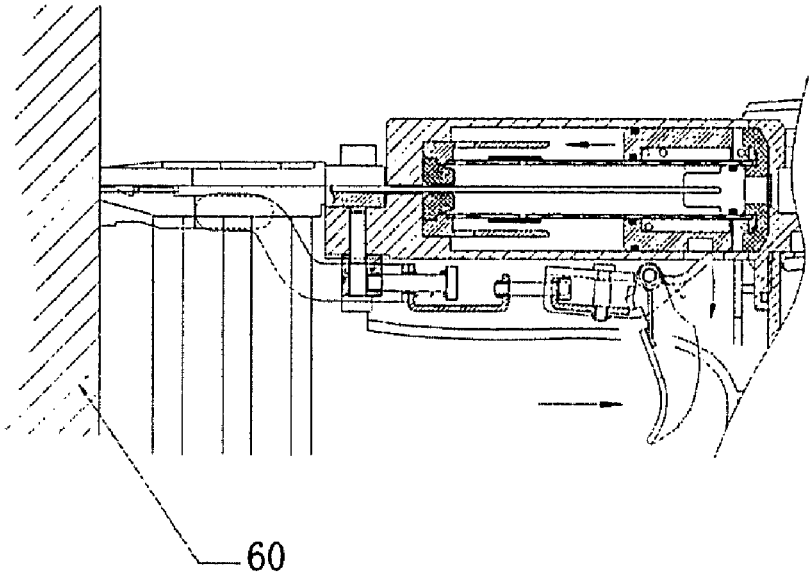
FIG. 3 is a partial structural schematic view of the trigger mechanism of the nail shooter in FIG. 1 at the moment of being triggered.

As shown in FIG. 2, when the nail shooter is pressed tightly against the workpiece, the safety transfer piece 46 will push the junction plate 43 to overcome elastic force of the safety spring 43 to move right, and further drive the safety interlocking plate 41 to move right. As shown in FIG. 3: Here if the trigger 38 is triggered, it will rotate counterclockwise, and drive the safety interlocking plate 41 to rotate clockwise, and further drive the guide pillar 40 on the safety interlocking plate 41 to move down; the guide pillar 40 then drives the safety trigger rod 42 to rotate clockwise; and when the safety trigger rod 42 moves to a certain position, its up right projecting end will escape from lower notch of the secondary piston 7; here the secondary piston 7 will move forward (i.e. move left) at a high speed under action of the elastic force of the compressed secondary spring 8, thus driving the primary switch 19 to move forward, the primary switch 19 being fixed together with the secondary piston 7 via the hammer striking plate 20.

Figure 4:
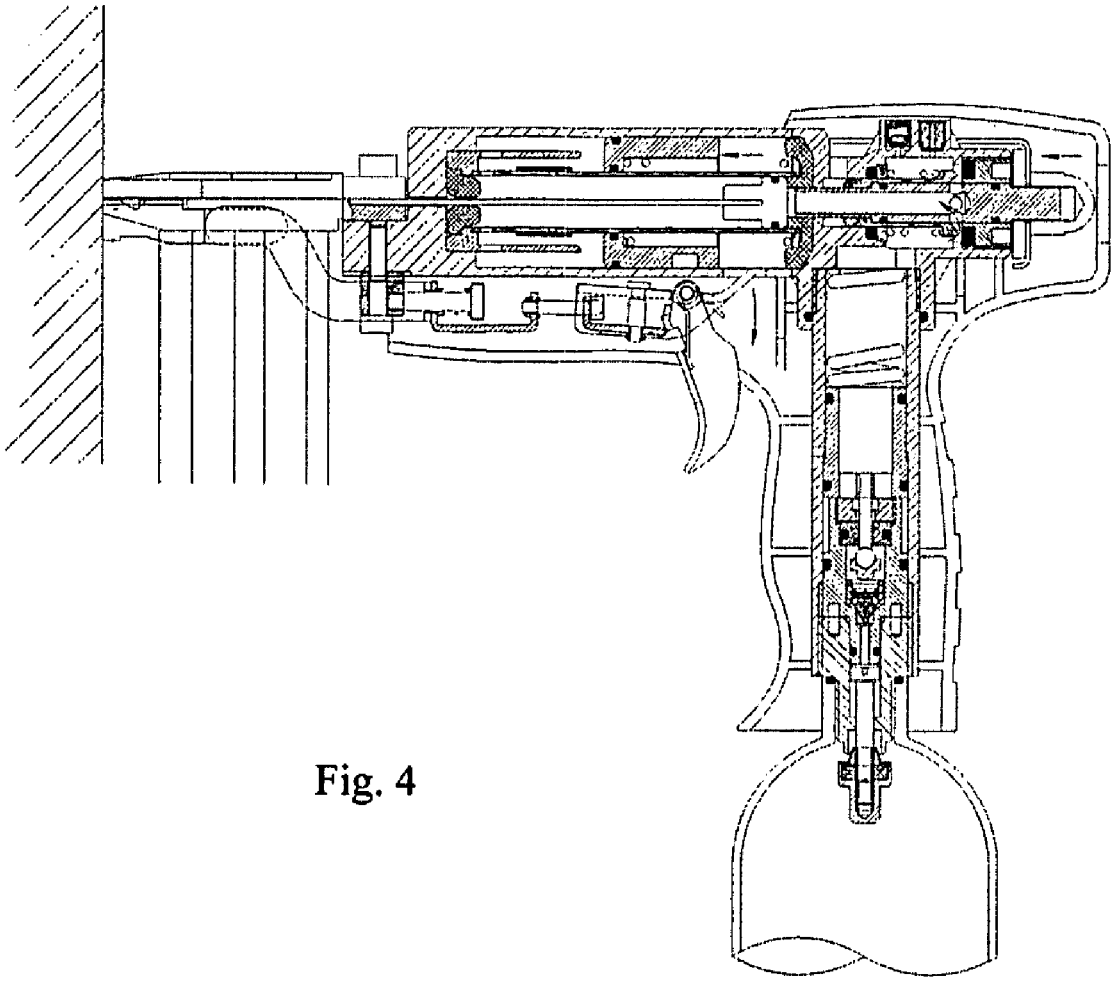
FIG. 4 is a partial structural schematic view of the switch mechanism of the nail shooter in FIG. 1 at the moment of being triggered.
Figure 5:
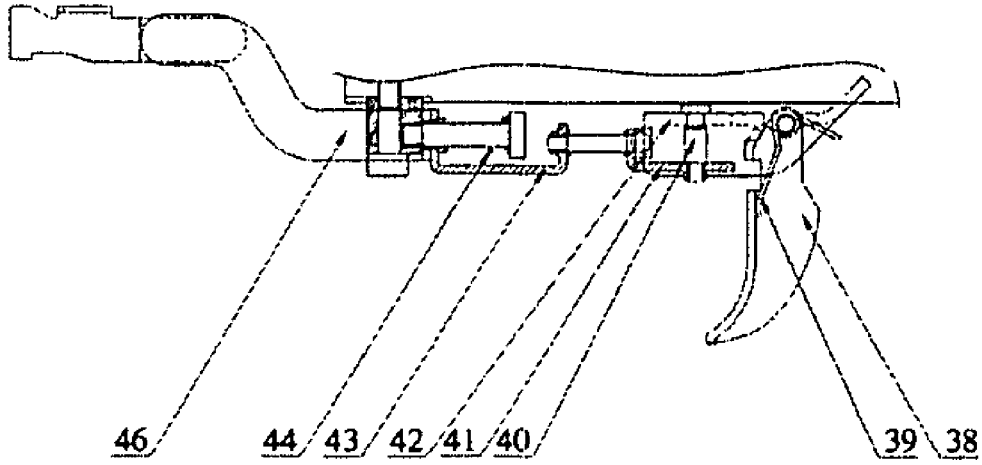
FIG. 5 is a structural schematic view of the trigger mechanism of the nail shooter in FIG. 1.
Figure 6:
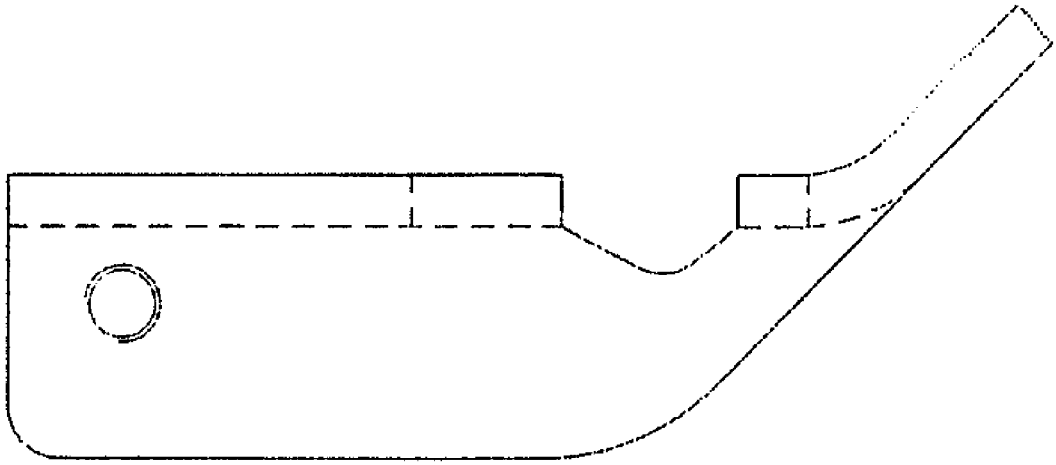
FIG. 6 is an enlarged schematic view of the safety trigger rod in FIG. 4.

As shown in FIG. 4: The primary switch 19 will strike the secondary switch 16 after moving forward by a certain distance, and drive the secondary switch 16 to also move forward; the primary switch 19 can form seal with the secondary shock absorbing sealing 10 when moving to a position where the secondary shock absorbing sealing 10 is located; meanwhile rear end port of the secondary switch 16 will escape from the switch sealing 17 and form a gas outlet, in an arrow direction as shown in FIG. 4; here the high-pressure gas entering the switch cavity of the main body 11 via the coupling tube 25 can enter cavity of the primary switch 19 via the primary switch blowhole and the formed gas outlet, and further enter the primary cylinder tube 5; the high-pressure gas in the primary cylinder tube 5 can push the primary piston 9 to move forward, thus driving the firing pin 1 on the primary piston 9 to move forward; nails in the nail box 45 are finally pushed forward, completing a nail shooting action.

C. Loading the Nail

After the primary piston 9 moves to a position such that its front end exceeds the gas outlet on the primary cylinder tube 5 (the gas outlet is provided with a one-way valve 6), the high-pressure gas in the primary cylinder tube 5 will flow into the outer piston cavity via this gas outlet. Here the high-pressure gas in the outer piston cavity can overcome elastic force of the secondary spring 8, and push the secondary piston 7 having moved to the front end to move back. When it returns to a position as shown in FIG. 1, the projecting end of the safety trigger rod 42 will move up and stretch into lower notch of the secondary piston 7 under action of the trigger spring 39. Thus the secondary piston is prevented from moving forward further, making the nails loaded and prepared for next nail shooting.

D. Returning a. Returning of the Secondary Switch

The secondary piston 7 will drive the primary switch 19 connected with the same to move back when moving to the rear end. Here the switch spring 15 will push the secondary switch 16 to move back returning. This makes the secondary switch 16 form seal again with the switch sealing 17, thus getting the high-pressure gas in switch cavity of the main body 11 sealed.

b. Returning of the Primary Piston

When the primary switch 19 escapes from the secondary shock absorbing sealing 10 due to moving back, cavity of the primary cylinder tube 5 on right side of the primary piston 9 and cavity of the secondary switch 16 will communicate with the atmosphere. Thus the high-pressure gas on right side of the primary piston 9 can be vented outside via the vent 52. On the other hand, part of the high-pressure gas previously flowing into the outer piston cavity via the return gas hole (located near the primary shock absorbing sealing 3) on the primary cylinder tube 5 can flow into front end of the primary piston 9 via the return gas hole at front end of the primary cylinder tube 5. Because here the secondary switch 16 has returned and the piston cavity at the back of the primary piston 9 communicates with the atmosphere, a pressure difference will be resulted between front and rear of the primary piston 9, thus making the primary piston 9 move back and complete the returning action.

2. Decompression Principle

Pressure of the high-pressurized gas in liquid state is very high, its critical pressure being usually about 72.8 standard atmospheres and its pressure varying much with temperature. The input high-pressurized gas in liquid state can be used only after being decompressed in order to ensure working stability of the nail shooter. In this embodiment, the decompressor decompresses the gas in the coupling tube 25, with the pressure being about 45 standard atmospheres after decompression.

The decompression principle is as below:

There is no high-pressure gas inside the coupling tube when the cylinder 37 is not communicated. Here under action of the decompression spring 24, the movable switch 26 is positioned in a lower limit position, and the decompression eject rod 27 matching tightly at lower part of the movable switch 26 positioned also in the lower limit position. Here the seal ball 30 pressing against lower part of the decompression eject rod 27 will escape from the decompression sealing 29, thus opening the opening here and making the gas flow up from here. The ball seat 31 therein is used to ensure that the seal ball 31 can be kept at an appropriate distance from the decompression sealing.

After the cylinder 37 is connected, the gas will flow into cavity of the movable switch 26 via an opening formed at a filter cover 33 and the seal ball 30. Because upper and lower sectional areas of the movable switch 26 are unequal (upper one smaller and lower one bigger in this embodiment) and two ends communicate with each other, pressure intensities are both equal to P. The pressure intensity will rise with infusing of the high-pressure gas.

Here:

The pressure exerted on the upper section $F_{upper}=PS_{upper}$, while the pressure exerted on the lower section $F_{lower}=PS_{lower}$, and $S_{upper}<S_{lower}$, therefore $F_{lower}>F_{upper}$.

Therefore, the movable switch 26 will move up to compress the decompression spring 24, and correspondingly the decompression spring 24 will produce a force $F_{spring}$ exerted on upper section of the movable switch 26. When $F_{lower}=F_{spring}+F_{upper}$, the movable switch 26 moves to an upper limit position. Here the decompression eject rod retracts completely into central hole of the decompression sealing 29, thus releasing the seal ball 30. The seal ball 30 will press against lower part of the decompression sealing 29 under action of the high-pressure gas, thus forming seal and making the high-pressure gas in the cylinder 37 unable to flow again into the movable switch 26. With the above-mentioned mechanism, the pressure intensity in the movable switch 26 can be kept at a desired predetermined value after connection of the cylinder 37 and before nail shooting, the pressure intensity being 45 standard atmospheres in this embodiment. $F_{lower}<F_{spring}+F_{upper}$ will occur after gas pressure in the movable switch 26 decreases due to nail shooting, thus making the movable switch 26 move down and driving the decompression eject rod 27 to press away the seal ball 30. Here the high-pressure gas in the cylinder 37 can flow again into the movable switch 26. When the internal pressure intensity rises to the predetermined value, the seal ball 30 will again close lower opening of the decompression sealing 29. It can be seen that, the above-mentioned structure can keep internal pressure intensity of the movable switch 26 at a desired predetermined value, thus realizing the decompression function and ensuring internal pressure intensity of the switch cavity of the shooter body communicated with the movable switch 26 to be at the predetermined value.

3. Advantages of the Nail Shooter of the Embodiment

It can be known from the above embodiment that, the nail shooter adopts the high-pressurized gas in liquid state as the power source with the following advantages:

A. Wide regulation range: A wide application range can be obtained with the high-pressurized gas in liquid state as the power source. It can not only be designed into such low-force nail shooters as pin nail shooter, straight nail shooter and staple shooter, but also into a cement nail shooter that has a higher force and can shoot a nail directly into a reinforced concrete wall.

B. Good mobile working performance: This nail shooter needs neither a bulky air compressor nor a nuisance of a ventilation tube. It has good mobile working performance, and can be used at a high altitude.

C. No need for a power supply: This pneumatic nail shooter does not need a power supply, and can still work in the field where no power supply is available or there is a power failure.

D. Explosion proof: With inert gases as the power source that will neither burn nor support combustion, the nail shooter has an explosion proof effect, and will not be heated during usage.

E. Low noise pollution: With no need for an air compressor, the nail shooter can be used with a very low noise and will not result in noise pollution.

What is claimed is:

1. A nail shooter driven by a high-pressurized gas in liquid state, the nail shooter comprising:

a shooter body and a handle connected with the same, the shooter body being provided with a trigger mechanism, a firing pin used for striking a nail to get it shot, a piston mechanism used for pushing the firing pin, and a switch mechanism used for releasing the driving gas toward the piston mechanism under control of the piston mechanism;

wherein:

the handle is provided with a coupling tube;

the coupling tube is provided in lower part of a cavity with an intake joint used for connection with a cylinder containing high-pressurized gas in liquid state to introduce the high-pressure gas;

the coupling tube is provided in central part of the cavity with a decompressor that is connected with the intake joint and decompresses the introduced high-pressure gas so as to keep gas pressure in upper part of the cavity of the coupling tube within a predetermined range; and under control of the trigger mechanism, the gas decompressed in the coupling tube can drive the piston mechanism via the switch mechanism, and further push the firing pin to strike the nail at a high speed to get it shot;

wherein the shooter body comprises the following components:

a main body used for mounting of the switch mechanism, the main body being connected with the handle and provided inside with a switch cavity;

a piston tube used for mounting of the piston mechanism, the piston tube being mounted in the front of the main body and provided inside with a piston cavity; and a nail-shooting table positioned in front of the piston tube, and used for fit connection with a nail box containing nails;

and wherein:

a female thread is provided at lower opening of the coupling tube for screwing the cylinder;

a hollow eject rod is positioned at lower part of the intake joint and can be connected with the cylinder to introduce the high-pressure gas;

a cylinder is used for containing the high-pressurized gas in liquid state;

a cylinder joint is positioned at opening of the cylinder;

a cylinder rod is positioned in the cylinder joint and can move up and down;

a cylinder sealing is positioned at lower part of the cylinder rod and can seal/open a gas port inside the cylinder joint with the cylinder rod moving up/down;

a male thread is provided on external diameter of the cylinder joint; and the cylinder can be screwed to lower part of the coupling tube through matching of the male and female threads;

in the structure, the hollow protruding rod can push against an intake rod provided with the cylinder to make the intake rod move down, thus opening the cylinder sealing to introduce the high-pressure gas in the cylinder into the coupling tube.

2. The nail shooter driven by the high-pressurized gas in liquid state according to claim 1, further comprising a nail box used for containing a multiple of pin nails, straight nails, staples, or cement nails.

3. A nail shooter driven by a high-pressurized gas in liquid state, the nail shooter comprising:

a shooter body and a handle connected with the same, the shooter body being provided with a trigger mechanism, a firing pin used for striking a nail to get it shot, a piston mechanism used for pushing the fifing pin, and a switch mechanism used for releasing the driving gas toward the piston mechanism under control of the piston mechanism;

wherein:

the handle is provided with a coupling tube;

the coupling tube is provided in lower part of a cavity with an intake joint used for connection with a cylinder containing high-pressurized gas in liquid state to introduce the high-pressure gas;

the coupling tube is provided in central part of the cavity with a decompressor that is connected with the intake joint and decompresses the introduced high-pressure gas so as to keep gas pressure in upper part of the cavity of the coupling tube within a predetermined range; and under control of the trigger mechanism, the gas decompressed in the coupling tube can drive the piston mechanism via the switch mechanism, and further push the firing pin to strike the nail at a high speed to get it shot; and wherein the decompressor comprises the following components:

a decompression spring positioned in upper part of the cavity of the coupling tube;

an up-and-down movable switch positioned in central part of the cavity of the coupling tube;

a decompression sealing positioned in upper part of the cavity of the intake joint and provided with a central through hole;

a seal ball that is positioned at a lower opening of the central through hole of the decompression sealing and can get the opening sealed;

a decompression eject rod extending from lower part of the movable switch into the central through hole of the decompression sealing and pushing open/releasing the seal ball with the movable switch moving up and down; and a ball seat used for holding the seal ball and keeping the seal ball in a position such that it is just opposite to the lower opening of the central through hole of the decompression sealing with an appropriate distance in between;

in the structure:

upper sectional area of the movable switch is smaller than lower sectional area;

a pressure difference produced by the same gas pressure on the upper and lower sections can compress the decompression spring to make the movable switch move up and down, which further drives the decompression eject rod back into the central through hole of the decompression sealing; and the seal ball will be completely released when the pressure difference is equal to elastic force of the decompression spring after being compressed, thus making the seal ball seal the lower opening of the central through hole of the decompression sealing.

4. The nail shooter driven by the high-pressurized gas in liquid state according to claim 3, wherein:

a female thread is provided at lower opening of the coupling tube for screwing the cylinder;

a hollow eject rod is positioned at lower part of the intake joint and can be connected with the cylinder to introduce the high-pressure gas;

a cylinder is used for containing the high-pressurized gas in liquid state;

a cylinder joint is positioned at opening of the cylinder;

a cylinder rod is positioned in the cylinder joint and can move up and down;

a cylinder sealing is positioned at lower part of the cylinder rod and can seal/open a gas port inside the cylinder joint with the cylinder rod moving up/down;

a male thread is provided on external diameter of the cylinder joint; and the cylinder can be screwed to lower part of the coupling tube through matching of the male and female threads;

in the structure, the hollow protruding rod can push against an intake rod provided with the cylinder to make the intake rod move down, thus opening the cylinder sealing to introduce the high-pressure gas in the cylinder into the coupling tube.

5. The nail shooter driven by the high-pressurized gas in liquid state according to claim 3, wherein the present invention can further include a nail box used for containing a multiple of pin nails, straight nails, staples, or cement nails.

6. The nail shooter driven by the high-pressurized gas in liquid state according to claim 3, wherein the piston mechanism comprises the following components:

a secondary piston that can move forward and backward in the piston cavity in the middle of the shooter body;

a secondary spring that can push the secondary piston forward;

a primary cylinder tube positioned in piston cavity of the shooter body such that the piston cavity is divided into inner and outer piston cavities, with rear part of the primary cylinder tube inserted into the secondary piston;

primary and secondary shock absorbing sealings positioned at front and rear ends of the primary cylinder tube, respectively; and a primary piston that can move forward and backward inside the primary cylinder tube under push of the gas;

in the structure, the primary piston can move forward under push of the high-pressure gas, and the firing pin positioned on the primary piston can move forward and backward with it.

7. A nail shooter driven by a high-pressurized gas in liquid state, the nail shooter comprising:

a shooter body and a handle connected with the same, the shooter body being provided with a trigger mechanism, a firing pin used for striking a nail to get it shot, a piston mechanism used for pushing the fifing pin, and a switch mechanism used for releasing the driving gas toward the piston mechanism under control of the piston mechanism;

wherein:

the handle is provided with a coupling tube;

the coupling tube is provided in lower part of the cavity with an intake joint used for connection with a cylinder containing high-pressurized gas in liquid state to introduce the high-pressure gas;

the coupling tube is provided in central part of the cavity with a decompressor that is connected with the intake joint and decompresses the introduced high-pressure gas so as to keep gas pressure in upper part of the cavity of the coupling tube within a predetermined range; and under control of the trigger mechanism, the gas decompressed in the coupling tube can drive the piston mechanism via the switch mechanism, and further push the firing pin to strike the nail at a high speed to get it shot; and wherein the piston mechanism comprises the following components:

a secondary piston that can move forward and backward in the piston cavity in the middle of the shooter body;

a secondary spring that can push the secondary piston forward;

a primary cylinder tube positioned in piston cavity of the shooter body such that the piston cavity is divided into inner and outer piston cavities, with rear part of the primary cylinder tube inserted into the secondary piston;

primary and secondary shock absorbing sealings positioned at front and rear ends of the primary cylinder tube, respectively; and a primary piston that can move forward and backward inside the primary cylinder tube under push of the gas;

in the structure, the primary piston can move forward under push of the high-pressure gas, and the firing pin positioned on the primary piston can move forward and backward with it.

8. The nail shooter driven by the high-pressurized gas in liquid state according to claim 7, wherein:

a return gas hole is provided on the foremost side wall of the primary cylinder tube to communicate the cavity of the primary cylinder tube with the outer piston cavity;

a gas outlet positioned on side wall of the primary cylinder tube at an appropriate distance from the front end to communicate cavity of the primary cylinder tube with the outer piston cavity;

an one-way valve positioned at the gas outlet to only allow the gas to flow from cavity of the primary cylinder tube to the inner piston cavity; and a vent positioned between the secondary shock absorbing sealing and the secondary switch to communicate the inner piston cavity with the atmosphere.

9. The nail shooter driven by the high-pressurized gas in liquid state according to claim 8, wherein:

a female thread is provided at lower opening of the coupling tube for screwing the cylinder;

a hollow eject rod is positioned at lower part of the intake joint and can be connected with the cylinder to introduce the high-pressure gas;

a cylinder is used for containing the high-pressurized gas in liquid state;

a cylinder joint is positioned at opening of the cylinder;

a cylinder rod is positioned in the cylinder joint and can move up and down;

a cylinder sealing is positioned at lower part of the cylinder rod and can seal/open a gas port inside the cylinder joint with the cylinder rod moving up/down;

a male thread is provided on external diameter of the cylinder joint; and the cylinder can be screwed to lower part of the coupling tube through matching of the male and female threads;

in the structure, the hollow protruding rod can push against an intake rod provided with the cylinder to make the intake rod move down, thus opening the cylinder sealing to introduce the high-pressure gas in the cylinder into the coupling tube.

10. The nail shooter driven by the high-pressurized gas in liquid state according to claim 8, wherein the present invention can further include a nail box used for containing a multiple of pin nails, straight nails, staples, or cement nails.

11. The nail shooter driven by the high-pressurized gas in liquid state according to claim 7, wherein the trigger mechanism comprises the following components:

a trigger for an operator to trigger; and a safety trigger rod interlocked with the trigger to control the secondary piston in the piston mechanism;

in the structure:

the secondary piston is provided at the lower part with a notch, into which projecting end of the safety trigger rod can be inserted to keep the secondary piston in a compressed state; and the projecting end of the safety trigger rod can escape from the notch with rotating of the trigger, and then release the secondary piston.

12. The nail shooter driven by the high-pressurized gas in liquid state according to claim 11, wherein the trigger mechanism further comprises the following components:

a safety press piece that is positioned at a nail shooting port of the shooter body, and can retract back to being parallel and level with the nail shooting port when being pressed;

a safety transfer piece connected with the safety press piece;

a junction plate that is connected with the safety transfer piece and can move forward and backward;

a safety spring that can push the junction plate forward to get reset; and a safety interlocking plate that can move back with the junction plate to get in contact with bayonet of the trigger;

in the structure, the safety trigger rod is connected with the safety interlocking plate via a guide pillar and can rotate under pull of the safety interlocking plate, and thereby projecting end of the safety trigger rod can escape from lower notch of the secondary piston and release the secondary piston.

13. The nail shooter driven by the high-pressurized gas in liquid state according to claim 7, wherein the switch mechanism is positioned in the switch cavity at the back of the shooter body, the switch mechanism comprising:

a main switch that is fixed together with the secondary piston via a hammer striking plate and can move forward and backward in the switch cavity;

a secondary switch that is sleeved outside the primary switch and can escape from the switch sealing at back of the primary switch with the primary switch moving forward; and a switch spring that can push the secondary switch back;

in the structure:

the primary switch is provided in the rear middle with a primary switch blowhole, which is provided on both sides with a sealing; and the primary switch can move forward with the secondary piston, and drive the secondary switch to escape from the switch sealing positioned at back of the secondary switch, making the gas in the coupling tube flow into the primary switch via an opening at the switch sealing and the primary switch blowhole, and further into the inner piston cavity to push the primary piston.

* * * * *